US005851288A

United States Patent [19]

Garand et al.

[11] Patent Number: 5,851,288

[45] Date of Patent: Dec. 22, 1998

[54] APPARATUS FOR MARKING A CONTINUOUS SUBSTRATE

[75] Inventors: Robert R. Garand, Carver; John L. Banda, Norwell; Charles Pike, Halifax, all of Mass.

[73] Assignee: Gem Gravure Company, Inc., West Hanover, Mass.

[21] Appl. No.: 986,771

[22] Filed: Dec. 8, 1992

Related U.S. Application Data

[60] Division of Ser. No. 777,078, Oct. 16, 1991, Pat. No. 5,228,918, which is a continuation-in-part of Ser. No. 605, 235, Oct. 29, 1990, abandoned.

[51] Int. Cl.[6] ..... B05C 11/00; B05C 13/00; B05C 13/02

[52] U.S. Cl. ..... 118/65; 118/68; 34/132; 34/624; 34/655

[58] Field of Search ..... 118/62, 64, 65, 118/68; 34/132, 107, 155, 160, 324, 655

[56] References Cited

U.S. PATENT DOCUMENTS

| | | | |
|---|---|---|---|
| 3,074,179 | 1/1963 | Stelling, Jr. | 34/160 |
| 4,102,300 | 7/1978 | Robert et al. | 118/67 |
| 4,231,164 | 11/1980 | Barbee | 34/16 |
| 4,365,425 | 12/1982 | Gotchel | 34/54 |
| 4,565,524 | 1/1986 | Rünkel et al. | 34/160 X |
| 4,674,197 | 6/1987 | Fleissner | 34/155 X |
| 4,708,887 | 11/1987 | Baxter et al. | 427/118 |
| 4,883,714 | 11/1989 | Stockl et al. | 428/412 |

FOREIGN PATENT DOCUMENTS

| | | |
|---|---|---|
| 0117054 | 1/1984 | European Pat. Off. . |
| 2427827 | 2/1975 | Germany . |
| 2546629 | 4/1977 | Germany . |
| 2217338 | 10/1989 | United Kingdom . |

*Primary Examiner*—David A. Simmons
*Assistant Examiner*—Paul M. Rivard
*Attorney, Agent, or Firm*—Hamilton, Brook, Smith & Reynolds, P.C.

[57] ABSTRACT

A system and a method for marking a continuous substrate, such as a sheathed wire, are disclosed. An aqueous-based ink is deposited onto a continuous substrate passing through an ink deposition means. A gas, heated by a heater and directed by a blower across the continuous substrate, heats the deposited aqueous-based ink in an amount sufficient to cause a pigment of the aqueous-based ink to bond to the substrate, thereby marking the continuous substrate. In an alternate embodiment, a system for marking a continuous substrate includes an elongate housing which is disposed substantially vertically. A continuous substrate, onto which an aqueous-based ink has been deposited, is directed upwardly through the housing. Gas, which has been heated in a tube disposed within the housing, is directed across the continuous substrate, causing the pigment of the aqueous-based ink to bond to the continuous substrate and thereby mark the continuous substrate.

14 Claims, 3 Drawing Sheets

APPARATUS FOR MARKING A CONTINUOUS SUBSTRATE

RELATED APPLICATIONS

This is a division of application Ser. No. 07/777,078, filed Oct. 16, 1991, now U.S. Pat. No. 5,228,918, which is a continuation-in-part of U.S. patent application Ser. No. 07/605,235, filed Oct. 29, 1990, now abandoned.

BACKGROUND OF THE INVENTION

Many industrial components such as wires, cables and medical tubing are continuously marked at high speed. For example, continuous substrates, such as sheathed wires, are often marked by directing them from a feed spool through a banding device which deposits an ink onto sheathing of the wire, either intermittently or as a continuous coating. The wire is then exposed to the atmosphere for a period of time sufficient to allow the ink to bond to the sheathing and thereby mark the wire before being wound onto a take-up spool. Preferably, wires are marked at speeds of up to, or greater than, about 3,500 feet per minute.

This production method typically employs organic solvent-based inks. However use of these inks often causes release of hazardous material, such as ketones, as gas and/or liquid wastes. Ketones, for example, have been linked to human respiratory problems and are believed to damage the ozone layer.

One attempt to reduce the release of hazardous material during marking of industrial components is to substitute organic solvent-based inks with aqueous-based inks. For example, release of hazardous organic solvents can be substantially reduced or eliminated by substituting organic solvent-based inks with aqueous-based inks. However, water has a lower vapor pressure than most organic solvents. Therefore, aqueous-based inks typically require a longer drying period than do other inks.

Longer drying periods during marking of a continuous substrate, such as wire, are generally obtained by substantially reducing the rate of speed at which the substrate travels between a feed spool and a take-up spool, or by increasing the distance between the point of ink deposition and the take-up spool. However, diminishing the speed at which the substrate is marked significantly reduces the efficiency of production. On the other hand, increasing the distance between the point of ink deposition and subsequent take-up of the substrate is bulky.

Thus, a need exists for a system and method for marking continuous substrates, such as sheathed wire, cables and medical tubing, with an aqueous-based ink which minimize or overcome the above-mentioned problems.

SUMMARY OF THE INVENTION

The present invention relates to a system and method for marking a continuous substrate.

The system includes deposition means for depositing an aqueous-based ink onto a continuous substrate, whereby a pigment of the aqueous-based ink can bond to the continuous substrate. Suitable means, disposed proximate to the means for depositing the aqueous-based ink, direct a gas across the aqueous-based ink on the continuous substrate at a rate sufficient and at a temperature sufficient to cause the pigment of the aqueous-based ink to bond to the continuous substrate, thereby marking the continuous substrate.

In one embodiment, the system includes an ink deposition means for depositing an aqueous-based ink onto a continuous substrate. A blower is disposed proximate to the ink deposition means for blowing a gas across the aqueous-based ink on the continuous substrate as the continuous substrate exits the ink deposition means. A heater is disposed at the blower for heating the gas blown through the blower to a temperature sufficient to cause a pigment of the aqueous-based ink to bond to the continuous substrate, thereby marking the continuous substrate.

In still another embodiment, the system includes an elongate housing, having an inlet end and an outlet end, for housing the continuous substrate as the continuous substrate is being directed through the housing from the inlet end to the outlet end. An elongate heater is disposed within the elongate housing and extends from the inlet end to the outlet end of the elongate housing. An outlet tube is disposed proximate to the elongate heater and is substantially parallel to the elongate heater within the elongate housing. The outlet tube has a gas inlet at a first end and defines a plurality of gas outlets disposed along the substantial portion of the length of the outlet tube, whereby a significant portion of gas directed through the gas inlet into the outlet tube is heated by the elongate heater, while being conducted through the tube, and is then discharged from the outlet tube through the gas outlets toward the continuous substrate in the housing, thereby passing across the continuous substrate and heating the aqueous-based ink in an amount sufficient to cause a pigment of the aqueous-based ink to bond to the continuous substrate and thereby mark the continuous substrate.

The method includes depositing an aqueous-based ink onto a continuous substrate, whereby a pigment of the aqueous-based ink can bond to the continuous substrate. A gas is directed across the aqueous-based ink on the continuous substrate at a rate sufficient and at a temperature sufficient to cause the pigment of the aqueous-based ink to bond to the continuous substrate, thereby marking the continuous substrate.

This invention has many advantages. For example, aqueous-based inks can be used to mark substrates, thereby significantly reducing the amount of potentially hazardous hydrocarbons released in generated liquid and air emissions. Further, aqueous-based inks can be deposited on continuous substrates at about the same rate as deposition of organic solvent-based inks. Also, aqueous-based inks deposited onto continuous substrates, such as sheathed wires, generally do not need to be exposed to the atmosphere for prolonged periods of time to mark the substrates.

DETAILED DESCRIPTION OF THE INVENTION

The features and other details of the system and method for marking a continuous substrate will now be more particularly described and pointed out in the claims. The same number present in different figures represents the same item.

It will be understood that the particular embodiments of the invention are shown by way of illustration and not as limitations of the invention. The principle features of this invention can be employed in various embodiments without departing from the scope of the claims.

Figure 1:
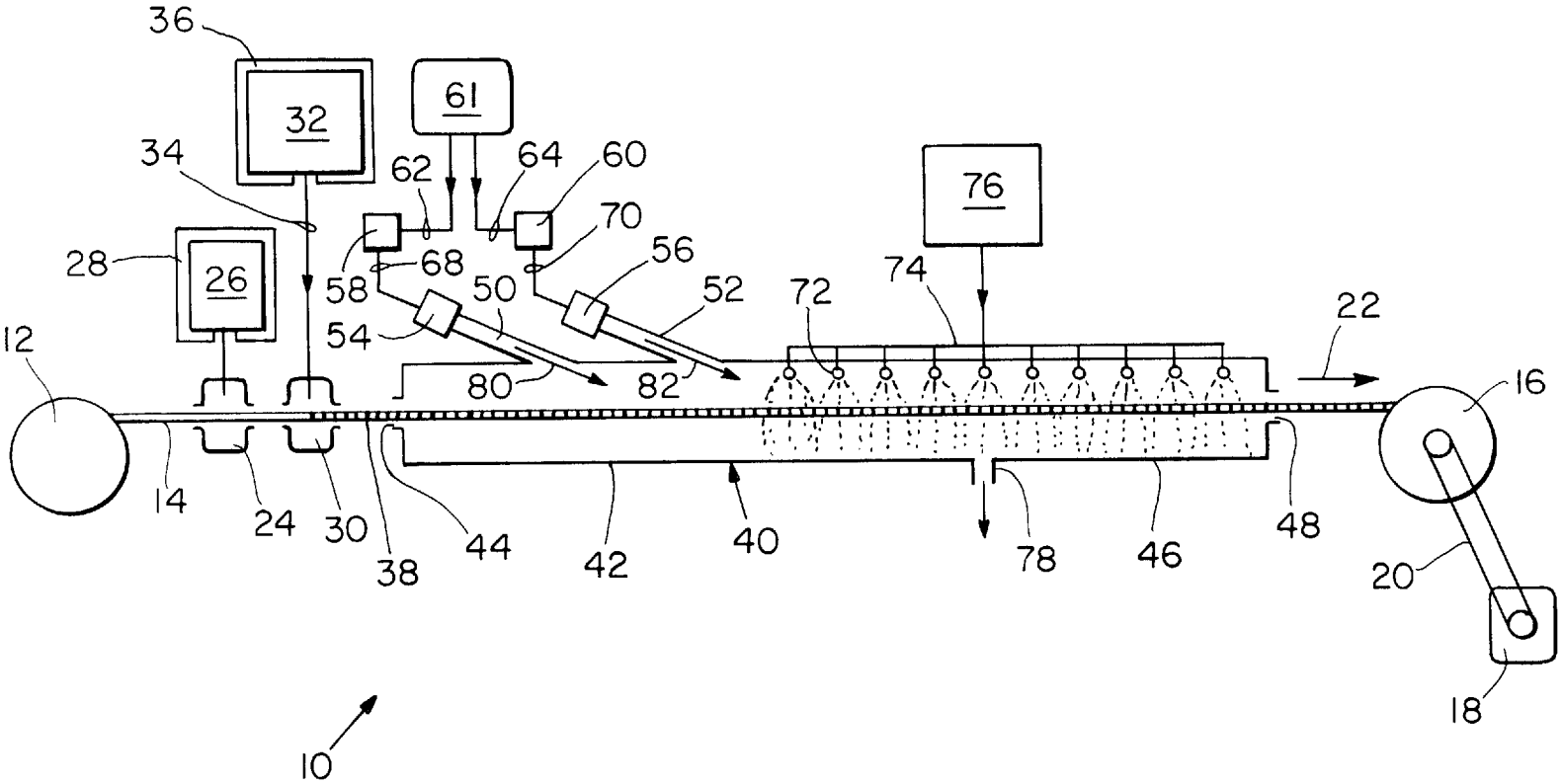
FIG. 1 is a schematic illustration of one embodiment of the system of the invention for marking a continuous substrate with an aqueous-based ink.

In one embodiment of the invention, illustrated in FIG. 1, system 10 includes feed spool 12 having wire 14 disposed thereon. Wire 14 extends from feed spool 12 to take-up spool 16. Take-up spool 16 is engaged with motor 18 by belt 20 for directing wire 14 from feed spool 12 to take-up spool 16. Motor 18 is activated and wire 14 is directed from feed spool 12 to take-up spool 16, as indicated by arrow 22, at a rate in the range of between about 2000 and about 7500 feet per minute. Preferably, wire 14 is directed from feed spool 12 to take-up spool 16 at a rate of about 3500 feet per minute.

Extruder head 24 is disposed between feed spool 12 and take-up spool 16. Extruder head 24 is connected to substrate polymer source 26. Heater 28 is disposed at substrate polymer source 26 for heating the substrate polymer. The substrate polymer is suitable for forming a sheathing about wire 14 and for being marked with an aqueous-based ink according to the method of the invention. Examples of suitable substrate polymers include: polyvinylchloride; polyvinylacetate copolymers; fluoro polymers, such as chlorotrifluorotriethylene (CTFE); etc.

The substrate polymer is heated at substrate polymer source 26 to a temperature sufficient to extrude the substrate polymer at extruder head 24 and thereby sheath wire 14. Preferably, the substrate polymer is heated to a temperature of about 350° F. The substrate polymer is then directed from substrate source through extruder head 24 onto wire 14, thereby sheathing wire 14 with the substrate polymer. The substrate polymer is directed from substrate polymer source 26 to extruder head 24 by a suitable method, such as by pressurizing substrate polymer source 26 by a suitable means, not shown.

The extruded substrate polymer forms a continuous sheath on wire 14 as wire 14 exits extruder head 24, thereby forming a continuous substrate. The substrate polymer of the sheath on wire 14 can be partially or completely polymerized when sheathed wire 14 exits extruder head 24. Polymerization of the substrate sheath can be completed by a suitable subsequent processing step, such as is known in the art of sheathing wire.

Band marker 30 is disposed along the path of sheathed wire 14 between extruder head 24 and take-up spool 16. Band marker 30 is suitable for depositing an aqueous-based ink onto the sheathing. Although the sheathing of sheathed wire 14 is employed as the continuous substrate in this embodiment, it is to be understood that, alternatively, other continuous substrates can be marked by the system and method of the invention. Examples of other suitable continuous substrates include cables and medical tubing.

Band marker 30 can deposit the aqueous-based ink either discontinuously, to form bands, or continuously, to form a continuous coating. An example of suitable band marker is an HS-BK-3000 model band marker, commercially available from Gem Gravure Company, Inc. An aqueous-based ink is disposed at ink source 32. Conduit 34 extends between ink source 32 and band marker 30. Heater 36 is disposed at ink source 32 for heating the aqueous-based ink before depositing the aqueous-based ink onto sheathed wire 14.

The aqueous-based ink includes a pigment which can be fixed to a suitable substrate by depositing the ink onto the substrate and then exposing the ink to conditions sufficient to cause a pigment of the ink to bond to the substrate. Preferably, the aqueous-based ink includes, in addition to the pigment, a polyester resin and an acrylic resin.

In one embodiment, suitable pigments include pigments which can be fixed within polymerized components of the ink and which are suitable for marking a substrate. The pigments should be suitable for use in aqueous-based inks. "Aqueous-based ink," as that term is used herein, means that water constitutes the largest single component of the ink. Preferably, the pigment is present in an amount in the range of between about two percent and about fifty percent, by volume. It is to be understood that more than one pigment can be present in the ink. Examples of suitable pigments include: Color Index (CI) Pigment Yellow 17; CI Pigment Blue 27; CI Pigment Red 49:2; CI Pigment Violet 23; CI Pigment Green 7; CI Pigment White 6; CI Pigment Black 7; etc.

Preferably, the polyester resin is suitable for fixing a pigment within the aqueous-based ink during exposure of the aqueous-based ink to conditions sufficient to cause the aqueous-based ink to form a coating. In a particularly preferred embodiment, the polyester resin is present in the aqueous-based ink in an amount in the range of between about four percent and about twenty percent, by volume.

The polyester resin can be prepared by a suitable method, such as is disclosed in U.S. Pat. Nos. 3,734,874, 3,779,993, 4,223,196 and 4,883,714, the teachings of which are incorporated herein by reference. The pigment and polyester resin can be obtained commercially as a mixture. An example of a suitable mixture of pigment and polyester resin is GPA 340 polyester resin, commercially available from Eastman Kodak Company.

The acrylic resin can comprise a thermoset or a thermoplastic. An example of a suitable acrylic resin includes Joncryl-77 acrylic resins, commercially available from Johnson's Wax, Inc. In one embodiment, the ratio of polyester resin to acrylic resin in the aqueous ink composition is in the range of between about 1:1 and about 4:1. In a particularly preferred embodiment, the ratio is about 2:1.

Additives can be included in the aqueous-based ink for facilitating deposition of the ink on substrate. Examples of such additives include defoaming agents, dispersants, wetting agents, biocides, etc.

Preferably, the aqueous-based ink is prepared by suitably combining the pigment with the polyester resin and the acrylic resin. In a particularly preferred embodiment, a suitable water-miscible organic solvent can be combined with the aqueous medium in which the pigment, polyester resin and acrylic resin are uniformly dispersed. An example of a suitable water-miscible organic solvent is isopropyl alcohol. The aqueous medium is present in the aqueous-based ink in an amount sufficient to cause the aqueous-based ink to have a viscosity suitable for depositing the aqueous-based ink onto a substrate by methods which are well-known. In one embodiment, the amount of water present in the aqueous medium is in the range of between about fifty percent and about ninety nine percent, by volume. Preferably, the water in the aqueous medium is deionized.

The water and the water-soluble polyester resin can be mixed in a suitable disperser. An example of a suitable disperser is a Cowles dissolver, commercially available from Moorehouse Industries, Inc. The water-soluble polyester resin is added to a vortex formed by the heated water in the disperser and is dispersed with the water for a period of time in the range of between about fifteen minutes and about thirty minutes. The water and polyester resin are then exposed to a suitable cooling medium, such as water, which is recirculated through a jacket, to maintain the temperature of the mixture in the range of between about 70° F. and about 90° F. during mixing.

The acrylic resin is then added to the water and polyester resin in the same manner that the polyester resin was added to the water. The water, polyester resin and acrylic resin are then cooled to a temperature in the range of between about 60° F. and about 90° F. In a particularly preferred embodiment, the water, polyester resin and acrylic resin are cooled to about 78° F.

The pigment and additives are added to the mixture of water, polyester resin and acrylic resin in the mixer after addition of the acrylic resin to thereby form the aqueous ink composition. In a preferred embodiment, the pH of the resulting aqueous-based ink is in the range of between about 6.0 and about 9.0. In a particularly preferred embodiment, the pH is in the range of between about 6.8 and about 8.0.

The aqueous-based ink is then mixed for a period of time and at a speed sufficient to reduce the particle size of the pigment granules to a size equal to or greater than about 0.7, as measured on a Hegman Grind Gauge. Preferably, the aqueous-based ink is mixed for a period of time in the range of between about one and about four hours.

It is to be understood that other suitable methods can be employed to combine the pigment, polyester resin and acrylic resin to form the aqueous-based ink. For example, the pigment can be combined with the polyester resin by milling the acrylic resin and polyester resin with the pigment until the particle size of the pigment has been sufficiently reduced. The milled mixture is then suitably dispersed in water. In another example, pigment can be combined with water in which the polyester resin and the acrylic resin have been dispersed. The aqueous-based ink of pigment, water, polyester resin and acrylic resin are mixed at high-speed rotation, such as at about 5,000 revolutions per minute, in a suitable mixer until the particle size of the pigment has been significantly reduced. The resultant ink mixture is then transferred to a suitable ball mill or sand mill for further milling to thereby further reduce the particle size of the pigment until a suitable particle size of the pigment has been attained.

In a particularly preferred embodiment, a premixed formulation of polyester resin, water and pigment, such as GPA-340 polyester varnish, commercially available from Eastman Kodak Company, is combined with a premixed formulation of acrylic resin, such as Joncryl-77 acrylic resin, commercially available from Johnson's Wax, Inc. The combined formulations form a suitable aqueous-based ink. The ratio of GPA-340 polyester resin to Joncryl-77 acrylic resin is in the range of between about 1:1 and about 4:1. Additional water and pigment can be added to the aqueous ink composition, if necessary, to cause the resultant aqueous-based ink to have a suitable viscosity and a sufficient amount of pigment for a selected application. The amount of water in the aqueous-based ink should be greater than about fifty percent, by volume. The polyester resin formulation and the acrylic resin formulation are combined by dispersion in a suitable disperser, such as a Cowles dissolver, at a temperature in the range of between about 60° F. and about 90° F. for a period of time in the range of between about one hour and about four hours, or until the particle size of the pigment is equal to or greater than about 0.7 on a Hegman Grind Gauge. Preferably, the temperature is maintained at about 68° F.

The aqueous-based ink can be employed on a wide variety of substrates. Examples of suitable substrates include, for example, substrates formed from polyethylene, chlorosulfonated polyethylene, polychloroprene, polyvinylidene fluoride, polytetrafluoroethylene, ethylene-propylene rubber, styrene-butadiene rubber, polyamide polymer, ethylene-chlorotrifluoro ethylene copolymer, nitrile rubber, butyl rubber, polyisoprene, etc. It is to be understood that the ink is also suitable for deposition onto other materials to which a pigment of the ink can bond during exposure of the ink to sufficient conditions.

The aqueous-based ink is directed from ink source to band marker 30 by a suitable means, such as by pressurizing the ink at ink source 32 or by gravity feed from ink source 32. In one embodiment, the temperature of the aqueous-based ink at ink source 32 is about 60°–100° F. The temperature of the aqueous-based ink can be controlled at ink source 32 by heating unit 36. Heating unit 36 can be, for example: a heating jacket through which a suitable medium, such as water, is circulated; an electrical coil; etc.

In one embodiment, the aqueous-based ink is directed on to the sheathing of sheathed wire 14 through band marker 30 to form identifying bands 38 at regular intervals along sheathed wire 12. The length of the interval between identifying bands 38 is, for example, about one inch. The width of identifying bands 38 is, for example, about one-half inch. Alternatively, sheathed wire 14 can be completely coated by the aqueous-based ink.

Housing 40 is disposed at sheathed wire 14 between band marker 30 and take-up spool 16. Housing 40 includes inlet end 42, which defines inlet 44 and also includes outlet end 46, which defines outlet 48. Sheathed wire 14 extends within housing 40 through inlet 44 and outlet 48. In one embodiment, housing 48 is about sixty feet long, one foot high and one foot wide. Inlet 44 and outlet 48 have a diameter of about three inches. Preferably, housing 40 is disposed about eighteen inches from band marker 30.

Housing 40 is constructed of a material suitable for housing sheathed wire 14 as it is heated in an amount sufficient to cause pigment of the aqueous-based ink to bond to the sheathing of sheathed wire 14 and for thereafter cooling sheathed wire 12. Examples of suitable materials of construction for housing 40 include stainless steel, etc.

Heat inlets 50,52 extend from inlet end 42 of housing 40. In one embodiment, heat inlets 50,52 are cylindrical and each have a diameter of about three inches. Heat inlets 50,52 are disposed linearly along the path of sheathed wire 14 through housing 12 for sequentially directing a heated gas over aqueous-based ink deposited on the sheathing of sheathed wire 12. In one embodiment, heat inlets 50,52 are disposed about three feet apart. A major axis of heat inlets 50,52 are each disposed at an angle relative to the path of sheathed wire 14 through housing 40, which causes a substantial portion of a hot gas directed through heat inlets 50,52 into housing 40 to pass through outlet end 46 and outlet 48 of housing 40. Preferably, heat inlets 50,52 are substantially parallel to each other and are disposed at an angle of about 10° relative to the path of sheathed wire 14 through housing 40.

First and second heaters 54,56 are disposed at heat inlets 50,52, respectively. Heaters 54,56 have a sufficient capacity to heat a gas directed through heaters 54,56 to a temperature sufficient to cause a pigment of the aqueous-based ink deposited on the sheathing to bond to the sheathing. An example of a suitable heater is a model 3000 hot air tool heater, commercially available from Karl Leister.

First and second blowers 58,60 are disposed at first and second heaters 54,56, respectively. Gas source 61 is disposed at heaters 54,56. Conduits 62,64 extend between gas source 66 and blowers 58,60. Conduits 68,70 extend between blowers 58,60 and heaters 54,56. Blowers 58,60 have sufficient capacity to direct heated gas to sheathed wire 14 at a rate which causes a pigment of the aqueous-based ink to bond to the sheathing. An example of a suitable blower is a Long Life model high-pressure blower, commercially available from Karl Leister.

Nozzles 72 extend along the path of sheathed wire through housing at outlet end. Conduits 74 extend between fluid source 76 and nozzles 72. Fluid at fluid source 76 is suitable for cooling sheathed wire 14 following bonding of pigment in the aqueous-based ink to sheathing at inlet end 42 of housing 40. An example of a suitable fluid for cooling sheathed wire 14 is water. Drain 78 extends from the bottom of housing 40 for draining coolant from housing 40.

Gas is directed from gas source 61 through conduits 62,64 and first and second heaters 54,56 by first and second blowers 58,60, respectively. The gas is heated at heaters 54,56 to a temperature in the range of between about 300° and 350° F. The heated gas is then directed from heaters 54,56 through heat inlets 50,52 into housing 40, as indicated by arrows 80,82. The heated gas then passes across sheathed wire 14 traveling through housing 40. The heated gas causes pigment in the aqueous-based ink deposited on sheathed wire 14 to bond to the sheathing of sheathed wire 14 as sheathed wire 14 moves through housing 40 from inlet 42 to outlet 46. Preferably, the flow of heated gas within housing 40 is turbulent. A substantial portion of the heated gas passes from inlet end 44 of housing 40 through outlet end 46 of housing 40 and out of housing 40 through outlet 48. An example of a suitable gas for heating and for direction over sheathed wire 14 in housing 40 is air.

Sheathed wire 14, to which pigment in the aqueous-based ink has bonded, is then directed through outlet end 46 of housing 40. Fluid is directed from fluid source 76 through conduits 74 and nozzles 72 by a suitable means, not shown, such as by pressurizing fluid at fluid source 76 or by pumping fluid through conduits 74. Preferably, the temperature of fluid directed through nozzles 72 is in the range of between about 40° and about 140° C. Fluid directed through nozzles 72 is sprayed over sheathed wire 14 and thereby cools sheathed wire 14 to a suitable temperature for collection on take-up spool 16. Preferably, sheathed wire 14 is cooled to about ambient temperature. Sheathed wire 14 is then directed through outlet 48 of housing 40 and is wound onto take-up spool 16. Fluid sprayed through nozzles 72 over sheathed wire 14 collects within housing 40 and drains from housing 40 through drain 78.

In a preferred embodiment, sheathed wire 14 is directed from feed spool 12 to take-up spool 16 continuously. However, it is to be understood that, alternatively, sheathed wire 14 can be directed from feed spool 12 to take-up spool 16 intermittently.

Figure 2:
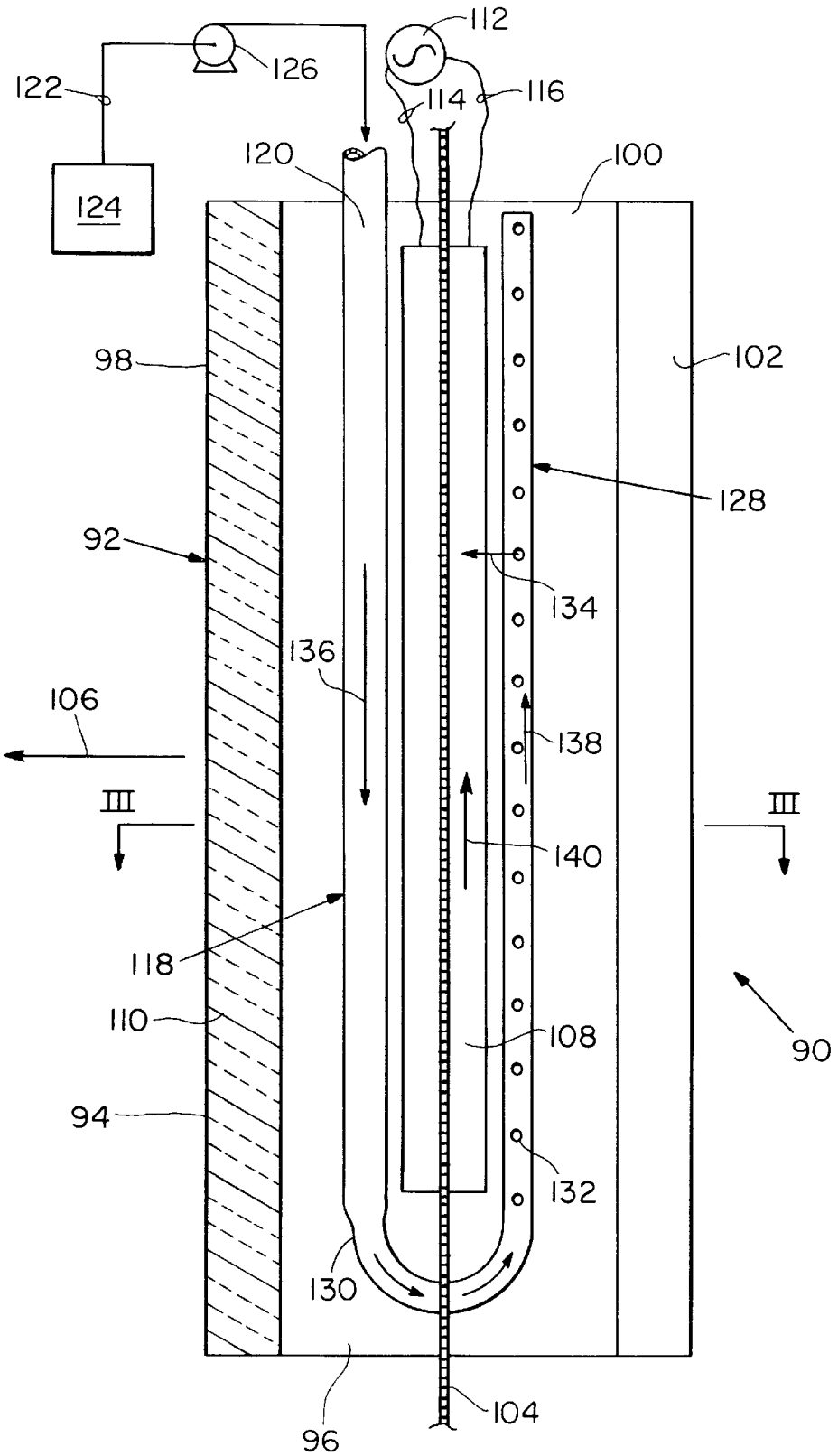
FIG. 2 is a section view of another embodiment of the system of the invention.

In an alternate embodiment of the invention, system 90, shown in section in FIG. 2, includes housing 92. Housing 92 has inlet end 94, which defines inlet 96, and outlet end 98, which defines outlet 100. Outlet end 98 is disposed above inlet end 94. Slot 102 is defined by housing 92 for removal of sheathed wire 104 from housing 92 by horizontal movement of housing 92, in a direction indicated by arrow 106. In one embodiment, housing has a height of about six feet, a diameter of about one foot and a width of about one foot. Sheathed wire 104, having an aqueous-based ink deposited thereon, is directed through inlet 96 at inlet end 94 of housing 92, through housing 92 and out of housing 92 through outlet 100 at outlet end 98 of housing 92.

Heater 108 is elongate and is disposed within housing 92. A major axis of heater 108 is substantially parallel to a major axis of housing 92 and is spaced apart from wire 104. Preferably, housing 92 includes insulation 110. In one embodiment, heater 108 is an electrical resistance heater. Heater 108 is connected to power source 112 by wires 114,116 for activating heater 108. An example of a suitable heater is a SE64 model electrical resistance heater, commercially available from Chromalox, Inc. Heater 108 has a capacity to heat air passing through housing 92 in an amount sufficient to cause pigment of the aqueous-based ink deposited on the sheathing of sheathed wire 104 to bond to the sheathing, thereby causing the aqueous-based ink to mark sheathed wire 104. Preferably, the temperature of air to which the aqueous-based ink deposited on sheathed wire 104 is in the range of between about 300° and 350° F.

Inlet tube 118 is disposed within housing 92 and is substantially parallel to heater 108. Inlet tube 118 is proximate to heater 108, whereby gas conducted through inlet tube 118 is heated by heater 108 to a temperature sufficient to cause pigment of the aqueous-based ink deposited on sheathed wire 104 to bond to the sheathing. Inlet tube 118 includes inlet end 120 disposed at outlet 100 of housing 92. Conduit 122 extends between gas source 124 and inlet end 120 of inlet tube 118. Pump 126 is disposed at conduit 122. Examples of suitable gas at gas source 124 include air, nitrogen, etc.

Outlet tube 128 extends from inlet tube 118 and is substantially parallel to heater 108. Outlet tube 128 is disposed on an opposite side of heater 108 relative to inlet tube 118. Outlet tube 128 includes gas inlet 130 which is connected to inlet tube 118, whereby gas heated in inlet tube 118 is conducted from inlet tube 118 through gas inlet 130 of outlet tube 128 and through outlet tube 128. Outlet tube 128 is disposed sufficiently close to heater 108 to cause heater 108 to at least maintain the temperature of gas directed from inlet tube 118 through outlet tube 128.

Outlet tube 128 defines a plurality of gas outlets 132 disposed along a substantial portion of the length of outlet tube 128. Gas outlets 132 are configured to direct heated gas from within outlet tube 128 in the general direction of sheathed wire 104 as sheathed wire 104 is directed through housing 92. In one embodiment, gas outlets 132 are configured to direct heated gas substantially perpendicularly to a major axis of housing 92, as indicated by arrow 134. Gas outlets 132 of outlet tube 128 preferably are disposed at three inch intervals and have a diameter of about 0.050 inches. Outlet tube 128 is sealed at an end opposite connection of outlet tube 128 to inlet tube 118.

Gas is directed from gas source 124 by pump 126 through conduit 122 and into inlet tube 118. The gas is directed through inlet tube 118 in a direction indicated by arrow 136. The gas is heated by heater 108 and is then conducted by inlet tube 118 through gas inlet 130 of outlet tube 128 and through outlet tube 128 in a direction indicated by arrow 138. Heated gas within outlet tube 128 is discharged from outlet tube 128 through gas outlets 132 toward sheathed wire 104 as sheathed wire 104 is directed through housing 92 in a direction indicated by arrow 140. The heated gas thereby passes across sheathed wire 104 and heats the aqueous-based ink deposited on sheathed wire 104 in an amount sufficient to cause pigment of the aqueous-based ink to bond to the sheathing of sheathed wire 104 and thereby mark sheathed wire 104.

The pressure of gas at inlet end 120 is preferably about five psig. Preferably, inlet tube 118 has a larger diameter than outlet tube 128. In one embodiment, inlet tube 118 has a diameter of about one-half inch and outlet tube 128 has a diameter of about three-eighth inches. An example of a suitable material of construction of inlet tube 118 and outlet tube 128 is copper.

Suitable material of construction for housing 92 includes, for example, stainless steel, etc. Suitable insulation materials include, for example, fiberglass.

Figure 3:
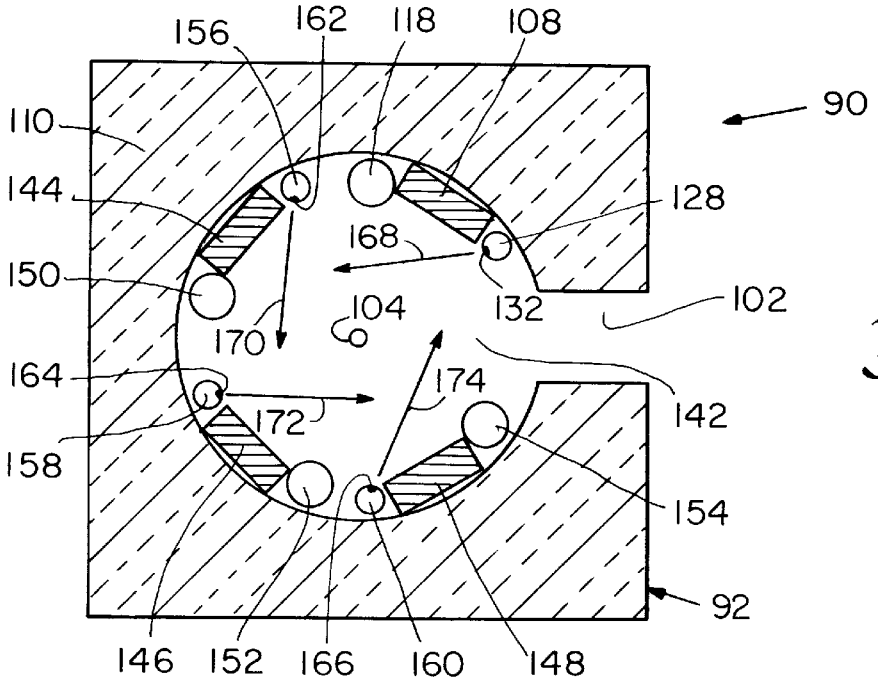
FIG. 3 is a section view of the embodiment illustrated in FIG. 2, taken along line III—III.

As can be seen in FIG. 3, which is a section of system 90 taken along line of III—III, housing 92 defines cylindrical chamber 142. Heater 108 and additional heaters 144,146, 148 are disposed about the periphery of cylindrical chamber 142. Additional inlet tubes 150,152,154 and additional outlet tubes 156,158,160 are disposed on opposite sides of heaters 144,146,148. Slot 102 is defined by housing 92 and extends from cylindrical chamber 142 to the exterior of housing 92.

Gas is directed through inlet tubes 118,150,152,154 and is heated by heaters 108,144,146,148. The heated gas is then directed through outlet tubes 128,156,158,160 and is discharged from outlet tubes 128,156,158,160 through gas outlets 132,162,164,166, respectively, in a direction which is substantially perpendicular to the path of sheathed wire 104 through cylindrical chamber 142. The preferred flow path of heated gas discharged from gas outlets 132,162,164,166 of outlet tubes 128,156,158,160 is indicated by arrows 168, 170,172,174. A circular path of air flow about sheathed wire 104 is thereby created to generate a turbulent flow of heated gas within cylindrical chamber 142. Heated gas discharged from gas outlets 132,162,164,166 into cylindrical chamber 142 circulates about sheathed wire 104 and rises within cylindrical chamber 142. The heated gas then escapes from cylindrical chamber 142 through the housing outlet, not shown. In a preferred embodiment, ambient air passes through the housing inlet, not shown, and is entrained with the heated gas, thereby passing through cylindrical chamber 142 and exiting housing 92 through the housing outlet. Aqueous-based ink deposited on sheathed wire 104 is preferably dry to the touch as sheathed wire 104 passes through the housing outlet.

Figure 4:
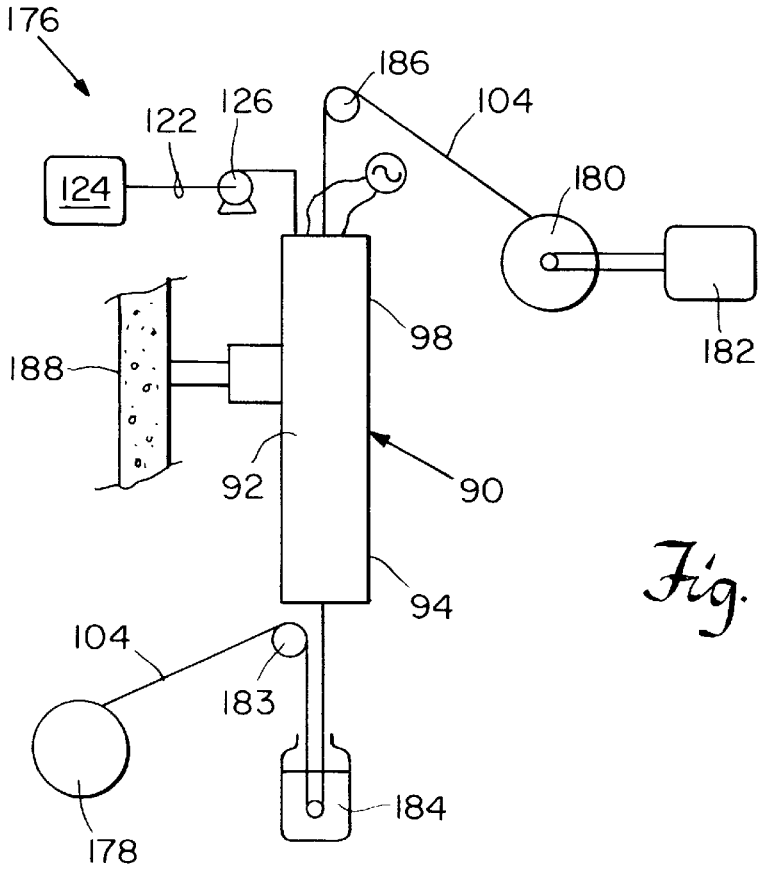
FIG. 4 is a schematic illustration of an embodiment of the present invention employing the system illustrated in FIGS. 2 and 3.

System 90 can be employed in a continuous process for sheathing and marking wire. For example, system 90 is included in system 176, shown in FIG. 4. Sheathed wire 104 is directed from feed spool 178 to take-up spool 180 by motor 182, which is engaged with take-up spool 180. Sheathed wire 104, between feed spool 178 and take-up spool 180, passes over roller 183 and is then immersed in ink bath 184, containing a suitable aqueous-based ink, and then directed vertically from ink bath 184 through system 90. Aqueous-based ink is deposited on sheathed wire 104 at ink bath 184. Aqueous-based ink deposited on sheathed wire 104 is exposed in system 90 to conditions sufficient to cause pigment in the aqueous-based ink to bond to the sheathing on sheathed wire 104. Sheathed wire 104 then exits system 90 and passes over roller 186 before being collected on take-up spool 180.

Moveable support 188 supports system 90 in a substantially vertical position, whereby inlet end 94 of housing 92 is disposed below outlet end 98 of housing 92. Sheathed wire 104 can be removed from system 90 by moving housing 92 is a substantially horizontal direction with moveable support 188.

Optionally, an extruder can be disposed between feed spool 178 and ink bath 184 for depositing a sheathing on a wire to form sheathed wire 104 before deposition of the aqueous-based ink onto sheathed wire 104.

Equivalents

Those skilled in the art will recognize, or be able to ascertain using no more than routine experimentation, many equivalents to the specific embodiments of the invention described herein. Such equivalents are intended to be encompassed by the following claims.

We claim:

1. A system for marking a continuous substrate, comprising:

a) an elongate housing, having an inlet end and an outlet end, for housing the continuous substrate as the continuous substrate is directed through the housing from the inlet end to the outlet end;

b) an elongate heater disposed within the elongate housing and extending from the inlet end to the outlet end of the elongate housing;

c) an outlet tube disposed proximate to the elongate heater and substantially parallel to the elongate heater within the elongate housing, the outlet tube having a gas inlet at a first end and defining a plurality of gas outlets disposed along a substantial portion of the length of the outlet tube, whereby a significant portion of gas directed through the gas inlet into the outlet tube is heated by the elongate heater, while being conducted through the outlet tube, and is then discharged from the outlet tube through the gas outlets toward the continuous substrate in the housing, thereby passing across the continuous substrate and heating the aqueous-based ink in an amount sufficient to cause a pigment of the aqueous-based ink to bond to the continuous substrate and thereby mark the continuous substrate.

2. A system of claim 1 further including an inlet tube extending from the inlet end of the outlet tube, the inlet tube disposed within the housing and substantially parallel to the elongate heater, the inlet tube being proximate to the elongate heater, whereby gas conducted through the inlet tube to the outlet tube can be heated by the elongate heater to a temperature sufficient to cause gas discharged from the outlet tube through the gas outlets to heat the aqueous-based ink in an amount sufficient to cause the pigment of the aqueous-ink based composition to bond to the continuous substrate and thereby mark the continuous substrate.

3. A system of claim 2 wherein the inlet tube and the outlet tube are disposed on opposite sides of the elongate heater.

4. A system of claim 3 further including a plurality of elongate heaters and a plurality of inlet tubes and outlet tubes within the housing, wherein an inlet tube and an outlet tube are disposed on opposite sides of each elongate heater.

5. A system of claim 4 wherein the housing defines a cylindrical chamber which is substantially parallel to the housing and wherein the elongate heaters, the inlet tubes and the outlet tubes are disposed.

6. A system of claim 5 wherein the elongate heaters are disposed at the periphery of the cylindrical chamber.

7. A system of claim 6 wherein the gas outlets are configured to direct the heated gas discharged from the outlet tubes substantially perpendicularly to a major axis of the cylindrical chamber.

8. A system of claim 7 wherein the gas outlets are configured to direct the heated gas between the central axis and the portion of the housing defining the cylindrical chamber.

9. A system of claim 8 wherein the housing further defines a slot extending along a side of the housing and substantially parallel to a major axis of the housing, whereby a continuous substrate extending the length of the cylindrical chamber can be removed from the housing by moving the housing in a direction substantially perpendicular to a major axis of the housing, thereby causing the continuous substrate to be removed from the cylindrical chamber through the slot.

10. A system of claim 9 further including means for supporting the housing, whereby the major axis of the housing is substantially vertical.

11. A system of claim 10 further including means for directing continuous substrate through the cylindrical chamber from the inlet end to the outlet end of the housing.

12. A system of claim 11 wherein the inlet end of the housing is disposed beneath the outlet end of the housing.

13. A system of claim 12 wherein the inlet of the outlet tube is disposed at the bottom of the housing.

14. A system of claim 13 further including sheathing means for sheathing a wire, the sheathing means disposed at a point along the path of the wire preceding entry of the wire into the cylindrical chamber, whereby a wire is sheathed to form the continuous substrate before being directed through the cylindrical chamber of the housing.

* * * * *